United States Patent [19]

Macchi

[11] 4,332,580

[45] Jun. 1, 1982

[54] PIECING MACHINE FOR NON-FABRIC RIBBONS

[75] Inventor: Massimo Macchi, Parabiago, Italy

[73] Assignee: Officine Savio S.p.A., Pordenone, Italy

[21] Appl. No.: 119,789

[22] Filed: Feb. 8, 1980

[30] Foreign Application Priority Data

Feb. 21, 1979 [IT] Italy ..... 83339 A/79

[51] Int. Cl.[3] ..... B31F 5/00

[52] U.S. Cl. ..... 493/346; 493/350; 493/390

[58] Field of Search ..... 493/390, 381, 350, 346, 493/340, 380, 379, 345, 344, 374; 242/58.1, 59

[56] References Cited

U.S. PATENT DOCUMENTS

| | | | |
|---|---|---|---|
| 2,486,204 | 10/1949 | Praizner | 493/346 |
| 3,741,079 | 6/1973 | Bossons et al. | 493/350 |
| 3,793,928 | 2/1974 | Wootten | 493/381 X |

*Primary Examiner*—James F. Coan

*Attorney, Agent, or Firm*—Stevens, Davis, Miller & Mosher

[57] ABSTRACT

The invention relates to a piecing machine suitable for end-wise joining of non-fabric ribbons by means of a jet of fluid (20) under pressure acting on the ends of the ribbons to be pieced together, at least one of the heads (16, 17) from which the fluid issues being displaceable relative to the other and there being provided means for pressing and compacting the joined ends after the piecing by the fluid jet is done.

5 Claims, 2 Drawing Figures

PIECING MACHINE FOR NON-FABRIC RIBBONS

The present invention relates to a piecing machine for non-fabric ribbons.

More specifically, the invention relates to a piecing machine utilizable for permanently joining the ends of two non-fabric ribbons.

The invention is, advantageously but not restrictively, used in collaboration with stretching, breaking, drawing or tow dyeing machines.

It is known that at present piecing action is achieved by sewing following the interposing of sealing elements (preferably paper), or, by knotting or even by glueing.

These known systems nevertheless have numerous disadvantages and drawbacks.

One inconvenience is due to a considerable amount of material being wasted since the part thus joined must be removed in the subsequent phases of ribbon utilization.

A second inconvenience is the long duration of the downstream machine stoppages in the work cycle that cause the loss of considerable production which could otherwise be obtained.

A further inconvenience is the fact that the machines downstream from the piecing machine once stopped must be very slowly restarted.

To obviate these drawbacks, the applicant has arrived at the present invention.

The piecing machine of the present invention offers numerious advantages.

The machine provides a saving in the material since all of the material is used.

The machine allows the continuity of the work cycle without stoppages and without excessive reduction of speed.

The machine further has the advantage that any operator can execute the piecing in a precise and fast manner.

According to the invention the ends of the nonfabric ribbons to be joined are paired and passed through a station which emits air under pressure.

According to an alternative embodiment, the compressed air emerges from a plurality of holes and contacts both faces of the overlapped ribbons.

According to a further alternative embodiment at least one of the air jets is mobile about an area, such area being fixed or variable.

According to one other alternative embodiment, the beginning and tail of the non-fabric ribbons once arranged and overlapped are pressed.

An object of the present invention therefore is to provide a piecing machine for non-fabric ribbons, in which at least a jet of fluid under pressure acts at least on the beginning or tail of the partially overlapped ribbons.

Other details and features of the invention will stand out from the description given below by way of non-limitative example and with reference to the accompanying drawings, in which.

Figure 1:
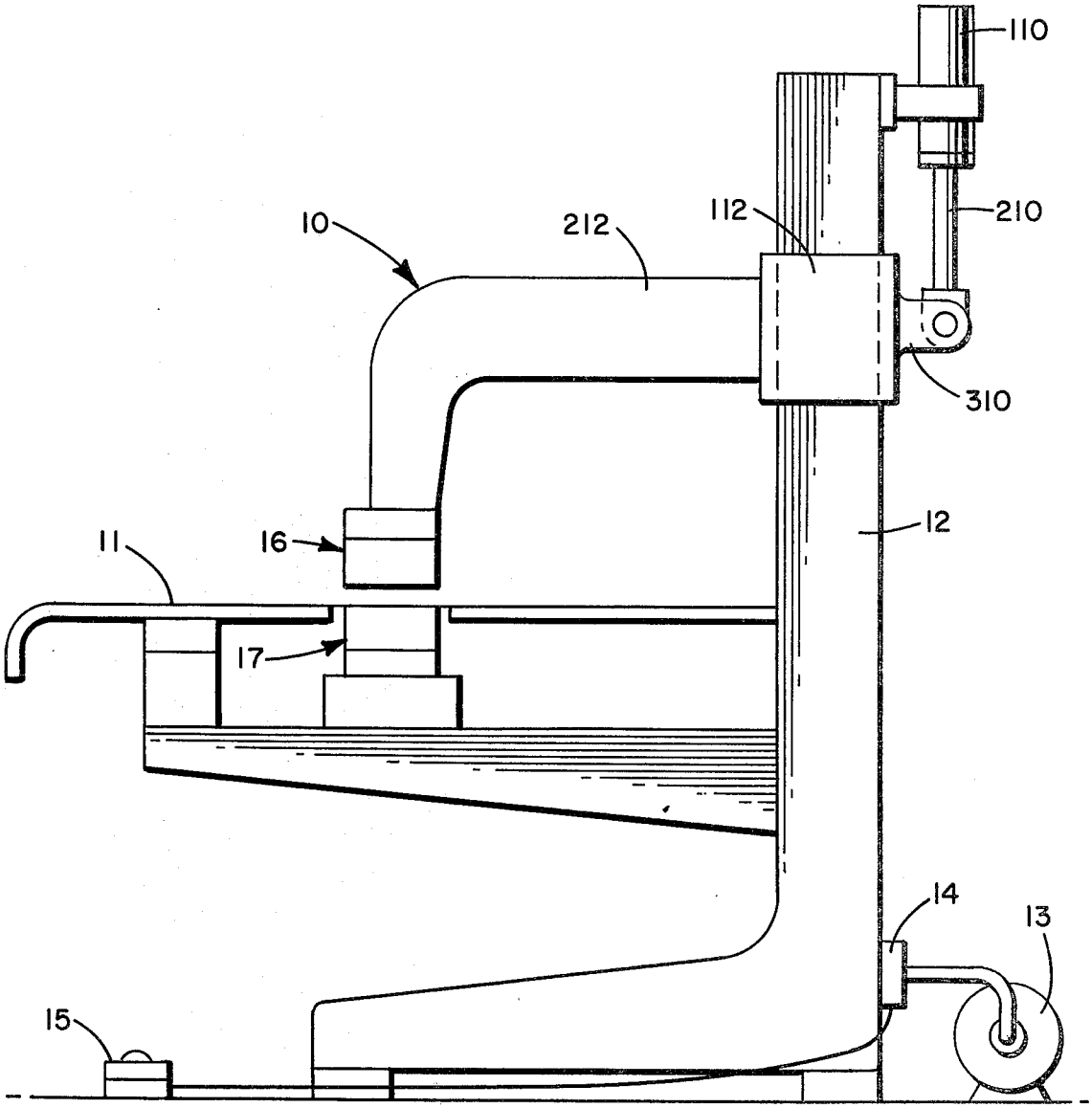
FIG. 1 illustrates a schematized and manual piecing machine.
Figure 2:
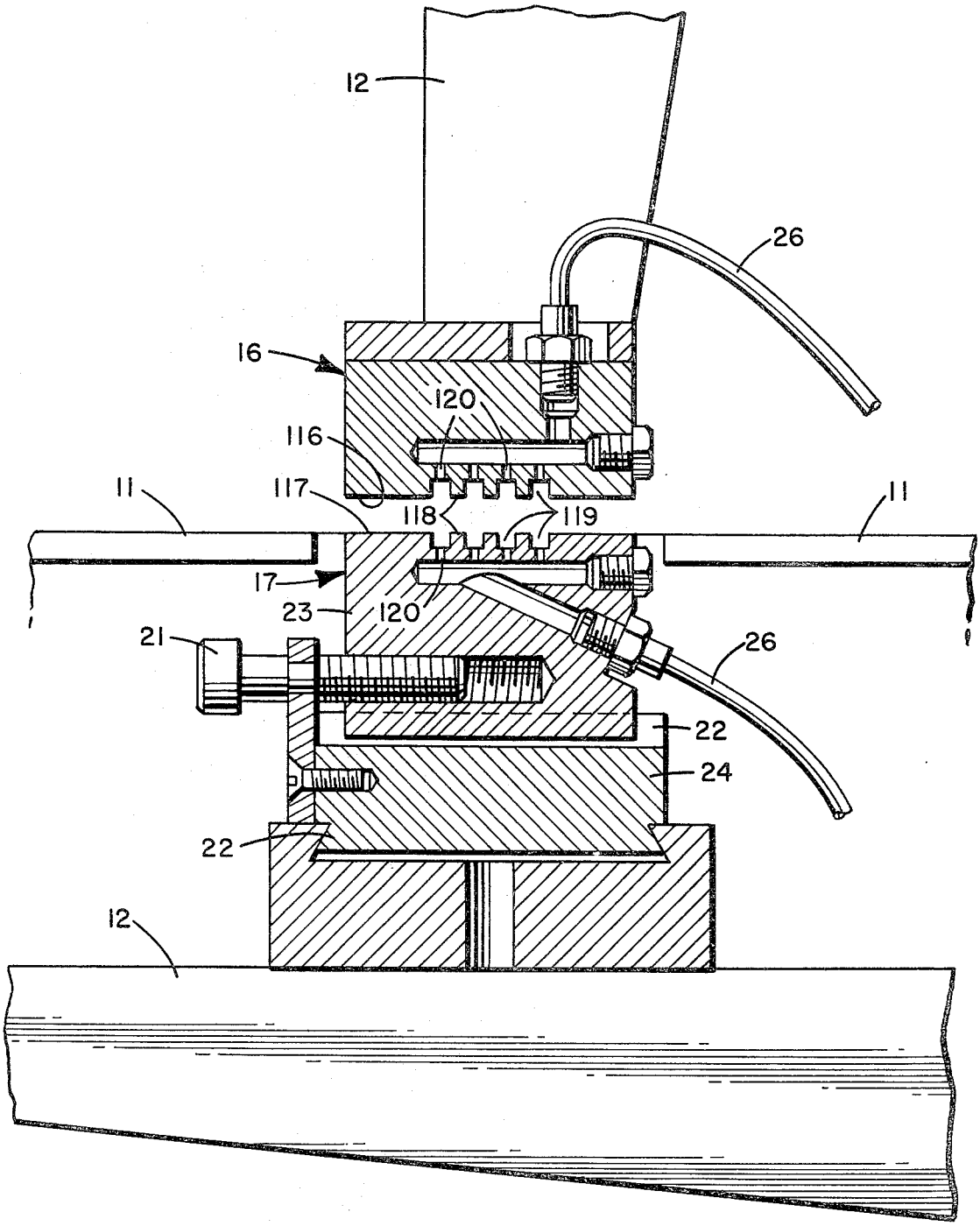
FIG. 2 illustrates an operating head of the piecing machine of FIG. 1.

In the drawings the piecing machine is designated as 10 and comprises; a support plane 11 on which the operator places the ends of the non-fabric ribbons before joining them; a frame 12 supporting the support plane 11; and upper and lower pneumatically operated operating heads 16 and 17 respectively. A source of fluid under pressure which is in itself known is utilized to operate the heads. There may be compressed fluid regulation and interception and/or purification organs which are known. Such organs may also include in a known way means for the injection into the compressed fluid of additives for treating the piecing area. For temporarily actuating the air under pressure, there are means 15 shown to be on the floor but then may be provided in any suitable place and of any suitable type. On the surface of heads 16 and 17 are ribs 18, such ribs can be longitudinal, trasversal or inclined but they can also have an undulated form. Recesses formed between the ribs 18 and have parts 20 therein through which pass the fluid under pressure. A screw means 21 serves to displace the body 23 in relation to the body 24 which is in turn displaceable with respect to the body 25 such that it is possible to position at will the operating head 17 in relation to the operating head 16. The regulation indicated above is of the static type, that is to say once the positioning is made it will be necessary to act positively for changing it. The operating head 17 can be displaced, if necessary, in relation to 16 in an automatic way. This can be done either by a winch or by substituting (for instance) one or both groups 21 by pneumatic pistons or similar suitable elements. Guides 22 are provided respectively between the bodies 23–24 and 24–25. Feed conduits 26 feed fluid under pressure to parts 20.

As previously stated, the operating heads 16 and 17 can be fixed or oscillating, or can be rotating, or movable along at least one axis.

Operating heads 16–17 can also be vertically fixed or mobile, the vertical mobility of head 16 can be achieved by horizontal arm 212 being fixed to a sleeve 112 slideable on frame 12 and activated by a pneumatic ram 110 fixed to frame 12, which ram carries a rod 210 fixed to the sleeve 112 at 310.

The vertical mobility can be such that it provides mutual temporary positioning or constantly defined positioning of the operating heads 16–17.

According to the invention, the ports 20 can be of different sections or of a sole section and can axially have any section.

Furthermore the ports 20 can inject the fluid both vertically or at an angle and such feature can be predetermined for all ports or can be varied for each port.

As an auxiliary to the operating heads there can be provided a pressing and compacting group, such a group can be pressure or compression operated and can consist of two plates which opproach each other with the required pressure. Such plates can include one flat section or a stepped section, in which case it is advantageous to include a lateral relative sliding movement between the plates themselves.

Now we see how the invention works.

The piecing machine is operated by placing the ends of the non-fabric ribbons on the surface 11 on top of each other and passing them between the operating heads 16 and 17.

The fluid under pressure is simultaneously actuated, which, on flowing through the ports 20, disarranges and mixes the fibers.

An eventual pressing action then executed by the pressing-compacting group serves to re-arrange and compact the same fibres.

According to the invention, the fluid under pressure can be air, vapor or other gas suitable for the purpose.

In the case of air or gas, the fluid can be at ambiental or a defined temperature.

The fluid under pressure can be normal or it may include some suitable additives such as oil, dressing, glue, resins, etc.

One preferential embodiment of the invention has been described but many alternatives are possible without going beyond the ambit of the invention.

It is thus possible to vary the proportions and dimensions. It is possible to replace the ribs 18 by a plurality of teeth. It is possible to have an automatic piecing station which may be provided in the advance line and can be switched on automatically ready for the joining action. It is possible to have one or both operating heads 16 and 17 mobile and adjustable on one of three axes.

These and other alternative embodiments are all possible within the scope of the invention.

I claim:

1. Piecing machine for non-fabric ribbons comprising upper and lower heads, at least one of said heads defining ports directed toward said other head for introducing jets of fluid between said heads, a source of fluid connected to said ports and a support plane for introducing said non-fabric ribbons between said heads to be acted upon by said jets, said head having ports has ribs extending between said ports.

2. The piecing machine according to claim 1 wherein both heads define fluid ports directed toward the other head.

3. The piecing machine according to claim 1 or claim 2, including means to press said heads together.

4. The piecing machine according to claim 1 or claim 2, including means to move said heads relative to each other horizontally.

5. The piecing machine according to claim 1 or claim 2, including means to move at least one head vertically.

* * * * *